US005248965A

United States Patent [19]

Yoshimitsu

[11] Patent Number: 5,248,965

[45] Date of Patent: Sep. 28, 1993

[54] DEVICE FOR DRIVING LIQUID CRYSTAL DISPLAY INCLUDING SIGNAL SUPPLY DURING NON-DISPLAY

[75] Inventor: Fukui Yoshimitsu, Nara, Japan

[73] Assignee: Sharp Kabushiki Kaisha, Osaka, Japan

[21] Appl. No.: 779,740

[22] Filed: Oct. 23, 1991

[30] Foreign Application Priority Data

Nov. 2, 1990 [JP] Japan ..... 2-298408

[51] Int. Cl.[5] ..... G09G 3/00

[52] U.S. Cl. ..... 345/211; 345/94; 345/208

[58] Field of Search ..... 340/784, 805, 811, 814, 340/723; 358/165, 236, 190

[56] References Cited

U.S. PATENT DOCUMENTS

| | | | |
|---|---|---|---|
| 4,525,710 | 6/1985 | Hoshi et al. | 340/784 |
| 4,556,880 | 12/1985 | Hamada | 340/784 |
| 4,656,470 | 4/1987 | Saka | 340/784 |
| 4,992,872 | 2/1991 | Hartmann et al. | 358/165 |
| 4,994,719 | 2/1991 | Lendaro | 358/190 |

*Primary Examiner*—Tommy Chin
*Assistant Examiner*—A. Au
*Attorney, Agent, or Firm*—Nixon & Vanderhye

[57] ABSTRACT

A device for driving a liquid crystal display device including common electrodes and segment electrodes to which scanning signals and display signals whose polarities are changed every half period of a frame signal are applied respectively. This device comprises a common electrode driving circuit, a segment electrode driving circuit, a display period control circuit for supplying the common electrode driving circuit and the segment electrode driving circuit with clock pulses, display data corresponding to an image to be displayed, and the frame signals during a display period in which an operation for displaying an image on the liquid crystal device is to be performed, and a non-display period control circuit for supplying the common electrode driving circuit and the segment electrode driving circuit with frame signals during a non-display period in which the displaying operation of an image on the liquid crystal display device is to be stopped.

3 Claims, 4 Drawing Sheets

DEVICE FOR DRIVING LIQUID CRYSTAL DISPLAY INCLUDING SIGNAL SUPPLY DURING NON-DISPLAY

BACKGROUND OF THE INVENTION

1. Field of the Invention

This invention relates to a device for driving an LCD device (liquid crystal display device).

2. Description of Related Art

FIG. 4 is a block diagram showing an electrical arrangement of a conventional LCD system. In FIG. 4, reference numeral 11 denotes a display memory, 12 a control circuit, 15 an LCD device, 13 a common driver for driving common electrodes of the LCD device 15, and 14 a segment driver for driving segment electrodes of the LCD device 15.

Display data stored in the display memory 11 is read out by the control circuit 12, and is sent along with clocks and frame signals to the common driver 13 and the segment driver 14. The common driver 13 and the segment driver 14 respectively supply common signals as scanning signals and segment signals corresponding to the display data to the LCD device 15. By this process, an image is displayed on the LCD device 15.

Generally, if a DC voltage is applied to a liquid crystal, an electrochemical reaction occurs at the parts of the liquid crystal which are contiguous to the electrodes, causing those parts to deteriorate. As a countermeasure, the common signals and the segment signals from the common driver and the segment driver are inverted by using a frame signal, whereby the polarities of those signals are changed every ½ period of the frame signal.

During a state in which an image is not displayed on the LCD device (hereafter referred to as the non-display state), the supply of the common and segment signals from the control circuit 12 to the LCD device 15 may be stopped. It often happens that the outputs of the common driver 13 and the segment driver 14 cannot be turned off. Even if the LCD device circuit is so configured that the outputs of the common driver 13 and the segment driver 14 are turned off during the non-display state, the response characteristics of the LCD device at activating the device again will deteriorate.

To prevent a deterioration of the response characteristics of the LCD device at the time of the device being activated again, there are two methods of circuit configuration by which the outputs of the common driver 13 and the segment driver 14 are not turned off during the non-display state.

A first method is to send signals corresponding to "non-lighting" from the control circuit 12 to the segment driver 14 continuously during the non-display state, and a second method is to stop the operation of the control circuit 12 and supply segment signals and common signals, which have a very little voltage difference with respect to each other, from the segment driver 14 and the common driver 13 to the LCD device 15 continuously during the non-display state.

However, according to the first method, the control circuit 12 operates during the non-display state in the same way as during the display state, so that the power consumption is not reduced. According to the second method, on the other hand, the control circuit 12 stops its operation, and therefore, the power consumption is reduced. However, since the supply of the frame signals to the common driver 13 and the segment driver 14 is also stopped, the common driver 13 and the segment driver 14 are unable to invert the common signals and the segment signals, and therefore, a DC bias voltage is applied to the LCD device 15, which accordingly deteriorates.

SUMMARY OF THE INVENTION

Therefore, the object of the present invention is to provide a device for driving an LCD device which can keep the LCD device in the non-display state without applying a DC bias voltage to the LCD device, and has smaller electric power consumption.

The object of the present invention can be achieved by a device for driving a liquid crystal display device having common electrodes and segment electrodes for receiving scanning signals and display signals respectively whose polarities are changed every half period of a frame signal, said driving device comprising:

a display period control circuit for outputting clock pulses, display data corresponding to an image to be displayed and frame signals during a display period in which an operation for displaying said image on said liquid crystal display device is to be performed;

a non-display period control circuit for outputting frame signals during a non-display period in which said operation is to be stopped;

a common electrode driving circuit for applying to said common electrodes scanning signals each having a selection waveform or a non-selection waveform formed from clock signals and frame signals received from said display period control circuit during said display period, and applying to said common electrodes scanning signals each having a non-selection waveform generated from frame signals received from said non-display period control circuit during said non-display period; and a segment electrode driving circuit for applying to said segment electrodes display signals representing lighting or non-lighting generated from said display data and frame signals received from said display period control circuit during said display period, and applying to said segment electrodes display signals representing non-lighting generated from said frame signals received from said non-display period control circuit.

In the device for driving a liquid crystal display device according to the present invention, the display period control circuit stops its operation during the non-display period in which the display operation of an image on the liquid crystal display device is to be stopped, so that the power consumption is reduced. Further, during the non-display period, scanning signals which are each inverted every ½ period of the frame signal being outputted from the non-display period control circuit and display signals representing non-lighting are applied to the common electrodes and the segment electrodes respectively. Therefore, a DC voltage is not applied to the liquid crystal, which is thus prevented from deteriorating.

Further objects and advantages of the present invention will be apparent from the following description, reference being made to the accompanying drawings wherein a preferred embodiment of the present invention is clearly shown.

BRIEF DESCRIPTION OF HE DRAWINGS

DETAILED DESCRIPTION OF A PREFERRED EMBODIMENT

Figure 1:
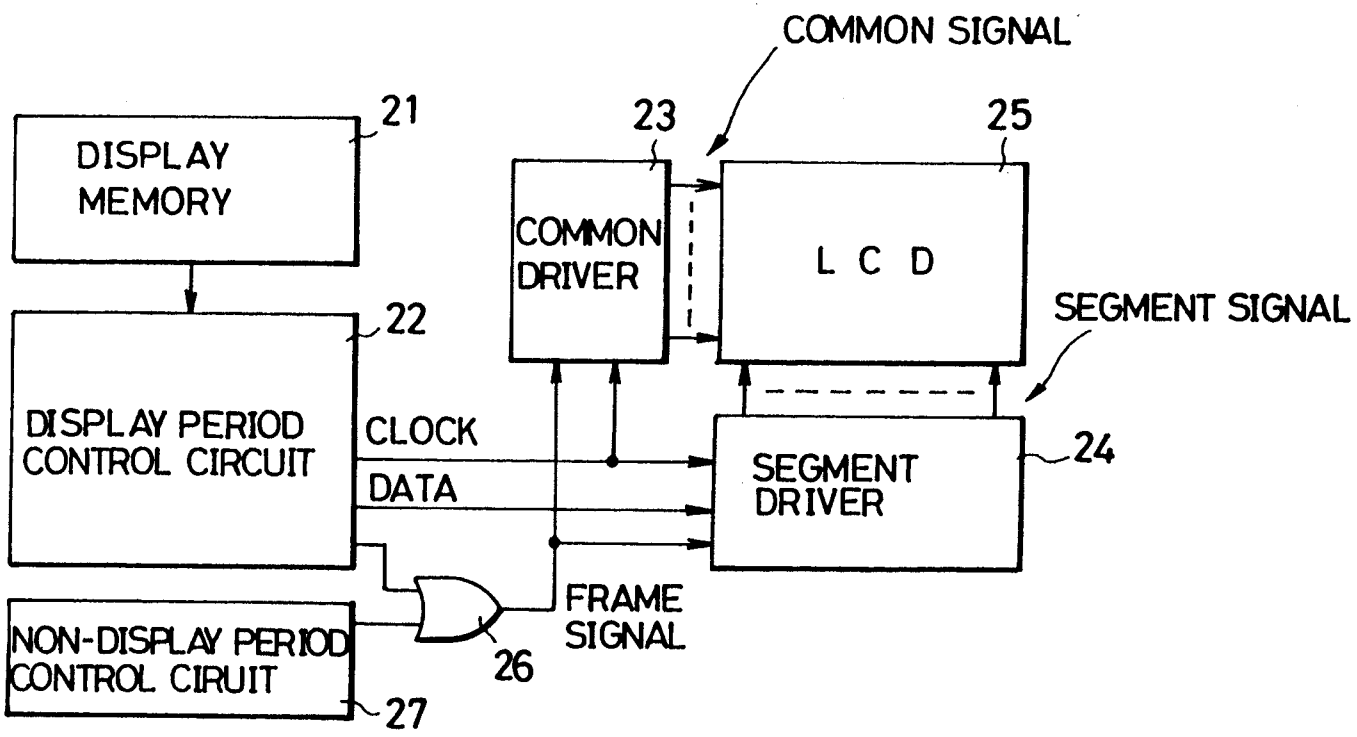
FIG. 1 is a block diagram showing a schematic electrical arrangement of an LCD system as an embodiment of the present invention.
Figure 2:
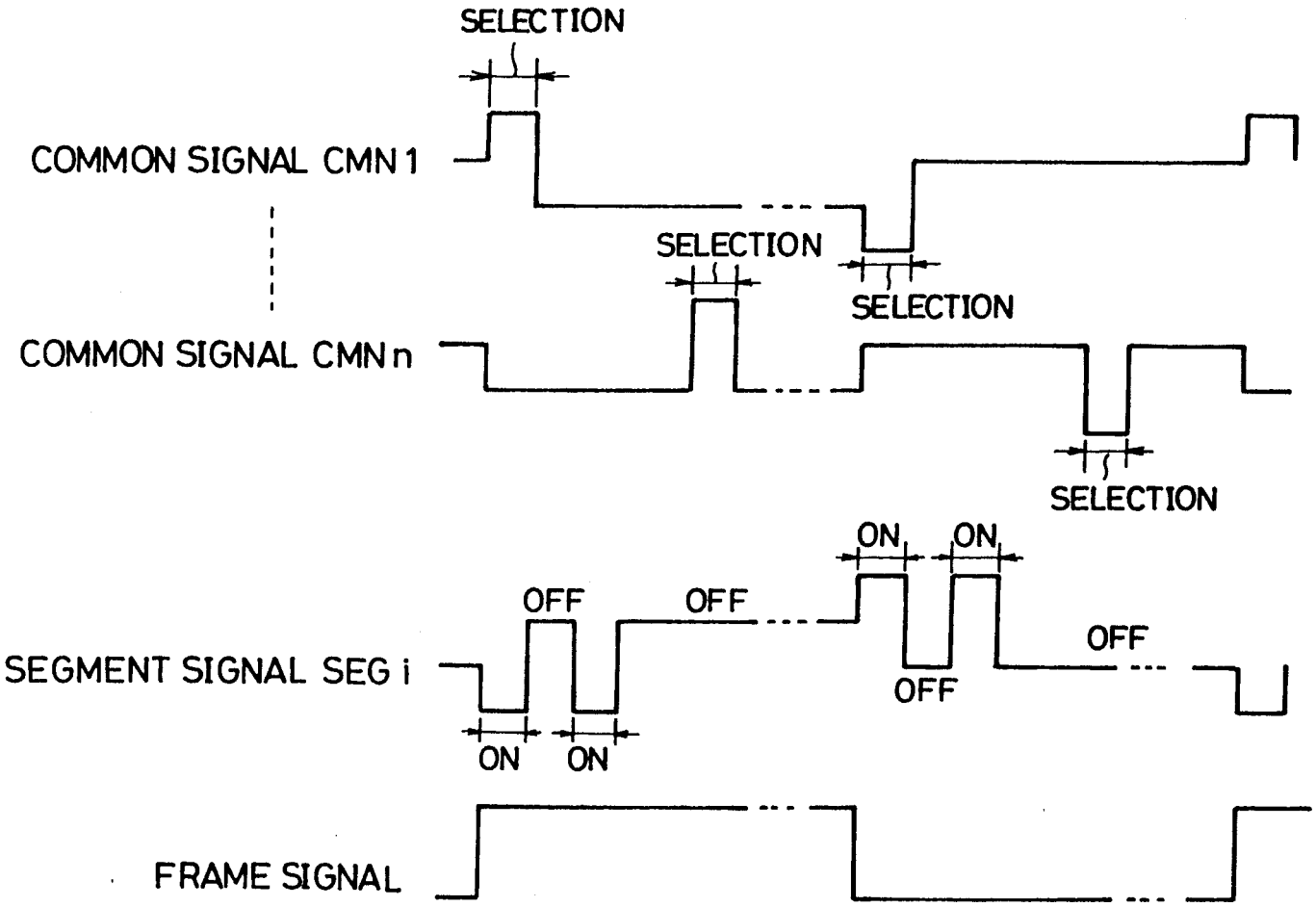
FIG. 2 is a time chart of the LCD system of FIG. 1, which is in the display state.
Figure 3:
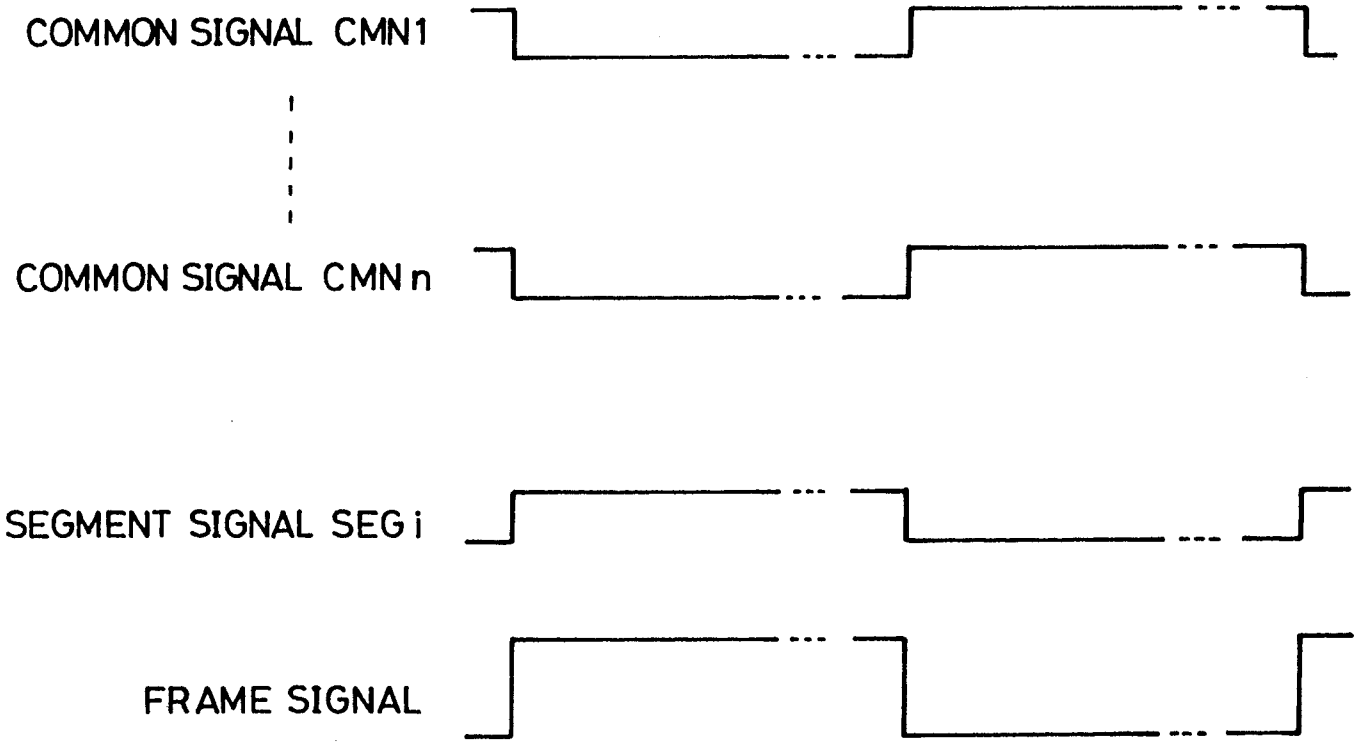
FIG. 3 is a time chart of the LCD system of FIG. 1, which is in the non-display state.
Figure 4:
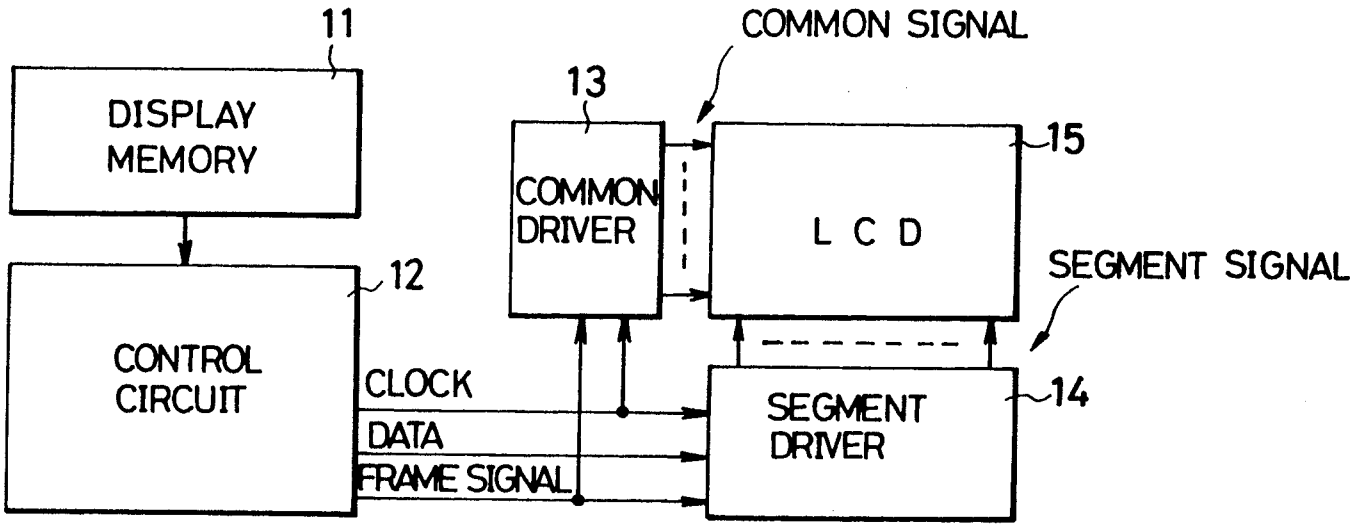
Fig. 4 (PRIOR ART)
FIG. 4 is a schematic block diagram of a conventional LCD system.

FIG. 1 is a block diagram schematically showing an electrical arrangement of a multi-duty drive LCD system as an embodiment of the present invention. FIG. 2 is a time chart showing the LCD system in the display state. FIG. 3 is a time chart of the LCD system in the non-display state.

In FIG. 1, reference numeral 21 denotes a display memory, 22 a display period control circuit, 25 an LCD device, 23 a common driver for driving common electrodes of the LCD device 25, and 24 a segment driver for driving segment electrodes of the LCD device 25.

Frame signals outputted from the display period control circuit 22 are supplied to one input of an OR gate. Frame signals outputted from the non-display period control circuit 27 are supplied to the other input of the OR gate 26. Output signals from the OR gate 26 are supplied to the common driver 23 and the segment driver 24.

The display memory 21 is an image memory for storing display data. Output data from the display memory 21 is supplied to the display period control circuit 22. Clock pulses from the display period control circuit 22 are supplied to the common driver 23 and the segment driver 24. Display data from the display period control circuit 22 is supplied to the segment driver 24. Outputs of the common driver 23 and the segment driver 24 are respectively applied to the common electrodes and the segment electrodes (both not shown) of the LCD device 25.

During the display state, the display period control circuit 22 supplies clock pulses and frame signals to the common driver 23 and the segment driver 24, and supplies display data to the segment driver 24. As a result, the common driver 23 forms scanning signals, that is, common signals CMNl to CMNn each having a selection waveform or a non-selection waveform as shown in FIG. 2, and applies those signals to the respective common electrodes. On the other hand, the segment driver 24 forms display signals, that is, segment signals SEGi each having an ON waveform corresponding to "lighting" or an OFF waveform corresponding to "non-lighting" and applies those signals to the respective segment electrodes. By this process, a voltage signal having an ON waveform or an OFF waveform in accordance with display data is applied to each pixel of the LCD device 25, thereby displaying an image. The common signals CMNl to CMNn and the segment signals SEGi are inverted every ½ period of the frame signal as shown in FIG. 2 so as to be AC drive signals.

During the non-display state, the display period control circuit 22 stops its operation, so that no clock pulses, frame signals nor display data are applied by the display period control circuit 22 to the common driver 23 and the segment driver 24. In this period, however, the non-display period control circuit 27 outputs frame signals as shown in FIG. 3, which signals pass through the OR gate 26 and are supplied to the common driver 23 and the segment driver 24. Consequently, the common driver 23 forms common signals CMNl to CMNn which are inverted every ½ period of the frame signal as shown in FIG. 3, and applies those signals to the respective common electrodes. On the other hand, the segment driver 24 forms segment signals SEGi which are inverted every ½ period of the frame signal as shown in FIG. 3, and applies those signals to the respective segment electrodes.

As described above, during the non-display state, the frame signals are not supplied from the display period control circuit 22, but they are supplied from the non-display period control circuit 27 instead, which is smaller than the display period control circuit 22 in circuit scale. Therefore, the power consumption of the LCD system is reduced remarkably compared with the conventional LCD system. Moreover, since the common signals CMNl to CMNn and the segment signals SEGi which invert periodically are applied to the LCD device 25, a DC bias voltage is not applied to the LCD device 25, so that the LCD device 25 is prevented completely from deterioration.

Many widely different embodiments of the present invention may be constructed without departing from the spirit and scope of the present invention. It should be understood that the present invention is not limited to the specific embodiment described in this specification, except as defined in the appended claims.

What is claimed is:

1. A device for driving a liquid crystal display which receives scanning signals and display signals whose polarities are periodically changed, said driving device comprising:

a display period control circuit for outputting display period clock signals, display data corresponding to an image to be displayed and a display period frame signal during a display period in which an operation for displaying said image on said liquid crystal display device is to be performed;

a non-display period control circuit for outputting a non-display period frame signal during a non-display period in which said operation is to be stopped;

a common electrode driving circuit for applying, to said display, common electrode scanning signals each having a selection waveform or a non-selection waveform formed from the display period clock signals and the display period frame signal received from said display period control circuit during said display period, and applying to said display the common electrode scanning signals each having a non-selection waveform generated from the non-display period frame signal received from said non-display period control circuit during said non-display period; and a segment electrode driving circuit for applying, to said display, segment electrode display signals representing lighting or non-lighting generated from said display data and the display period frame signal received from said display period control circuit during said display period, and applying to said display the segment electrode display signals representing non-lighting generated from said non-display period frame signal received from said non-display period control circuit;

said display period control circuit being turned off during said non-display period.

2. A device according to claim 1, wherein said display period frame signal outputted from said display period control circuit and said non-display period frame signal outputted from said non-display period control circuit are inputted into an OR gate respectively, and an output of said OR gate is supplied to said common electrode driving circuit and said segment electrode driving circuit.

3. A device according to claim 1, further comprising a memory for storing image data of the image to be displayed.

* * * * *